US010932027B2

(12) United States Patent
Maguire

(10) Patent No.: US 10,932,027 B2
(45) Date of Patent: Feb. 23, 2021

(54) WEARABLE AUDIO DEVICE WITH DOCKING OR PARKING MAGNET HAVING DIFFERENT MAGNETIC FLUX ON OPPOSING SIDES OF THE MAGNET

(71) Applicant: Bose Corporation, Framingham, MA (US)

(72) Inventor: Stephen J. Maguire, Grafton, MA (US)

(73) Assignee: Bose Corporation, Framingham, MA (US)

( * ) Notice: Subject to any disclaimer, the term of this patent is extended or adjusted under 35 U.S.C. 154(b) by 51 days.

(21) Appl. No.: 16/290,928

(22) Filed: Mar. 3, 2019

(65) Prior Publication Data

US 2020/0280788 A1 Sep. 3, 2020

(51) Int. Cl.
*H04R 1/10* (2006.01)

(52) U.S. Cl.
CPC ..... *H04R 1/1041* (2013.01); *H04R 1/1016* (2013.01); *H04R 1/1025* (2013.01); *H04R 2420/07* (2013.01)

(58) Field of Classification Search
CPC .. H04R 1/1016; H04R 1/1025; H04R 1/1041; H04R 1/1058; H04R 1/1075; H04R 2420/07
USPC ..... 381/74, 380
See application file for complete search history.

(56) References Cited

U.S. PATENT DOCUMENTS

| | | | |
|---|---|---|---|
| 5,126,669 | A | 6/1992 | Hones et al. |
| 5,991,085 | A | 11/1999 | Rallison et al. |
| 9,141,194 | B1 | 9/2015 | Keyes et al. |
| 9,854,345 | B2 | 12/2017 | Briggs |
| 10,212,507 | B1 | 2/2019 | Maguire et al. |
| 2005/0092919 | A1 | 5/2005 | Bellec et al. |
| 2005/0111673 | A1 | 5/2005 | Rosen et al. |
| 2006/0018075 | A1 | 1/2006 | Schultz |
| 2006/0034478 | A1 | 2/2006 | Davenport |
| 2007/0092093 | A1 | 4/2007 | Shim |
| 2011/0273169 | A1 | 11/2011 | LaCroix |
| 2011/0291497 | A1 | 12/2011 | Choi |
| 2012/0219166 | A1 | 8/2012 | Ball |
| 2013/0272563 | A1 | 10/2013 | Boyd |
| 2013/0329910 | A1 | 12/2013 | Crosby et al. |

(Continued)

FOREIGN PATENT DOCUMENTS

| | | | |
|---|---|---|---|
| EP | 2645750 | A1 | 10/2013 |
| WO | 2013155217 | A1 | 10/2013 |

OTHER PUBLICATIONS

The International Search Report and the Written Opinion of the International Searching Authority dated Jul. 4, 2019 for PCT Application No. PCT/US2019/020914.

(Continued)

*Primary Examiner* — Katherine A Faley
(74) *Attorney, Agent, or Firm* — Brian M. Dingman; Dingman IP Law, PC

(57) ABSTRACT

A wearable audio device including a magnetic device and a docking or parking magnet that has opposed first and second sides and produces a magnetic field, wherein the flux of the magnetic field from the first side has a greater magnitude than the flux of the magnetic field from the second side, and wherein the second side is closer to the magnetic device than is the first side.

20 Claims, 7 Drawing Sheets

(56) References Cited

U.S. PATENT DOCUMENTS

| | | | | |
|---|---|---|---|---|
| 2015/0003662 | A1* | 1/2015 | Vernon | H04R 3/00 381/399 |
| 2015/0181355 | A1 | 6/2015 | Pedersen | |
| 2015/0195639 | A1* | 7/2015 | Azmi | H04R 1/1058 381/74 |
| 2015/0326963 | A1 | 11/2015 | Sorensen et al. | |
| 2015/0365755 | A1* | 12/2015 | Harper | H04R 1/1033 381/384 |
| 2017/0014071 | A1 | 1/2017 | Readdie et al. | |
| 2017/0090003 | A1 | 3/2017 | Guo | |
| 2017/0093079 | A1* | 3/2017 | Wagman | A45C 13/02 |
| 2017/0160086 | A1 | 6/2017 | Kesaniemi | |
| 2017/0208382 | A1 | 7/2017 | Grinker | |
| 2017/0295443 | A1* | 10/2017 | Boesen | H04R 1/1016 |
| 2018/0088185 | A1 | 3/2018 | Woods et al. | |
| 2018/0096770 | A1 | 4/2018 | Danielson et al. | |
| 2018/0115816 | A1 | 4/2018 | Panecki et al. | |
| 2018/0193728 | A1 | 7/2018 | Bashkirov et al. | |
| 2018/0211751 | A1 | 7/2018 | Khoshkava et al. | |
| 2019/0281376 | A1 | 9/2019 | Maquire et al. | |

OTHER PUBLICATIONS

U.S. Appl. No. 62/626,967, filed Feb. 6, 2018; Applicant: Bose Corporation.

The International Search Report and the Written Opinion of the International Searching Authority dated Jun. 29, 2020 for PCT Application No. PCT/US2020/023485.

* cited by examiner

WEARABLE AUDIO DEVICE WITH DOCKING OR PARKING MAGNET HAVING DIFFERENT MAGNETIC FLUX ON OPPOSING SIDES OF THE MAGNET

BACKGROUND

This disclosure relates to a wearable audio device such as an earphone.

Wearable audio devices (e.g., earbuds or headphones) can include orientation tracking systems that use a magnetometer to track motions of the head and the direction in which the wearer is looking. Magnetometers need to accurately detect the Earth's magnetic field. The wearable audio device's electro-acoustic transducer typically includes a magnet. The wearable audio device can also include a magnet used to dock or park the wearable audio device to another structure. Since some wearable audio devices, such as in-ear headphones (sometimes also called earbuds) are desirably quite small, of necessity the magnetometer is close to the other magnets. The magnetic field of the other magnets may have a magnetic field strength that is much greater than the Earth's magnetic field. Accordingly, the magnetic fields can overwhelm the magnetometer and prevent it from working properly.

SUMMARY

All examples and features mentioned below can be combined in any technically possible way.

In one aspect, a wearable audio device includes a magnetic device, and a docking or parking magnet that has opposed first and second sides and produces a magnetic field. The flux of the magnetic field from the first side of the docking or parking magnet has a greater magnitude than the flux of the magnetic field from the second side. The second side is closer to the magnetic device than is the first side.

Examples may include one of the above and/or below features, or any combination thereof. The magnetic device may comprise a magnetic field sensor. The magnetic field sensor may comprise a magnetometer. The magnetic field sensor may comprise a three-axis magnetometer. The docking or parking magnet may comprise a Halbach array. The Halbach array may comprise a discrete array comprising at least three permanent magnets arranged side-by-side and with the north poles of three adjacent magnets all pointing in different directions. The Halbach array may comprise a continuous array comprising a monolithic structure comprising at least three magnetic regions arranged side-by-side and with the north poles of three adjacent regions all pointing in different directions.

Examples may include one of the above and/or below features, or any combination thereof. The magnetic device may comprise a transducer magnet of an electro-acoustic transducer that is adapted to create an audio output. The magnetic device may further comprise a magnetic field sensor, and the combined magnetic fields from the docking or parking magnet and the transducer magnet, at the location of the magnetic field sensor, may be less than either the strength of the magnetic field from the transducer magnet at the location of the magnetic field sensor or the strength of the magnetic field from the docking or parking magnet at the location of the magnetic field sensor. The wearable audio device may further comprise a housing that is constructed and arranged to be positioned at or near an ear of a wearer so as to direct the audio output towards the ear of the wearer, wherein the housing comprises an outer wall. The docking or parking magnet may be positioned in the housing adjacent to the housing outer wall.

Examples may include one of the above and/or below features, or any combination thereof. The wearable audio device may comprise an earbud with an earbud body, and the magnetic device and the docking or parking magnet may be located in the earbud body. The magnetic device may comprise a magnetic field sensor that has a sensed magnetic field range where it operates linearly, and the strength of the magnetic field from the docking or parking magnet, at the location of the magnetic field sensor, may be such that the sensed magnetic field strength is in the sensed magnetic field range where the magnetic field sensor operates linearly.

In another aspect, a wearable audio device includes a housing that is constructed and arranged to be positioned at or near an ear of a wearer so as to direct an audio output towards the ear of the wearer. The housing comprises an outer wall. A magnetometer is located in the housing and is configured to sense the Earth's magnetic field. An electro-acoustic transducer is located in the housing and is configured to create the audio output. The transducer comprises a transducer magnet that produces a transducer magnetic field having a transducer magnetic field strength. A docking or parking magnet comprises a Halbach array of at least three side-by-side permanent magnets or magnetic regions of a monolithic structure, wherein the north poles of three adjacent permanent magnets or magnetic regions all point in different directions. The docking or parking magnet has opposed first and second sides. The first side of the docking or parking magnet faces and is proximate to the outer wall of the housing, and the second side of the docking or parking magnet is closer to the magnetometer than is the first side of the docking or parking magnet. The flux of the magnetic field from the first side of the docking or parking magnet has a greater magnitude than the flux of the magnetic field from the second side of the docking or parking magnet.

Examples may include one of the above and/or below features, or any combination thereof. The strength of the combined transducer magnetic field and the magnetic field from the second side of the docking or parking magnet, at the location of the magnetometer, may be less than either the strength of the transducer magnetic field at the location of the magnetometer or the strength of the magnetic field from the second side of the docking or parking magnet at the location of the magnetometer. The magnetometer may have a sensed magnetic field range where it operates linearly, and the strength of the combined transducer magnetic field and the magnetic field from the second side of the docking or parking magnet, at the location of the magnetometer, may be such that the sensed magnetic field strength is in the sensed magnetic field range where the magnetometer operates linearly. The magnetometer may comprise a three-axis magnetometer. The magnetic field from the first side of the docking or parking magnet may have a primary magnetic pole orientation facing into the housing, and the transducer magnetic field may have a primary magnetic pole orientation facing away from the docking or parking magnet.

Examples may include one of the above and/or below features, or any combination thereof. The docking or parking magnet may comprise a center bar magnet with opposed first and second ends, and with its north pole pointed toward the housing, a first end bar magnet adjacent to the first end of the center bar magnet and with its north pole pointing toward the center bar magnet, and a second end bar magnet adjacent to the second end of the center bar magnet and with its north pole pointing toward the center bar magnet. The docking or parking magnet may comprise a center magnetic region with opposed first and second ends, and with its north pole pointed toward the housing, a first end magnetic region adjacent to the first end of the center magnetic region and with its north pole pointing toward the center magnetic region, and a second end magnetic region adjacent to the second end of the center magnetic region and with its north pole pointing toward the center magnetic region. The wearable audio device may be configured to be clasped to another structure that comprises a clasping Halbach array. The magnetic field from the first side of the docking or parking magnet may have a first primary magnetic pole orientation facing into the housing. When the wearable audio device is clasped to the other structure, the clasping Halbach array of the other structure may have an opposite, second primary magnetic pole orientation facing toward the docking or parking magnet. The other structure may comprise a second earphone. The other structure may comprise a battery charger.

BRIEF DESCRIPTION OF THE DRAWINGS

FIG. 8 is a partial, schematic view of the adjacent docking or parking magnets of an earphone and a second structure that the earphone is coupled to.

DETAILED DESCRIPTION

Figure 1:
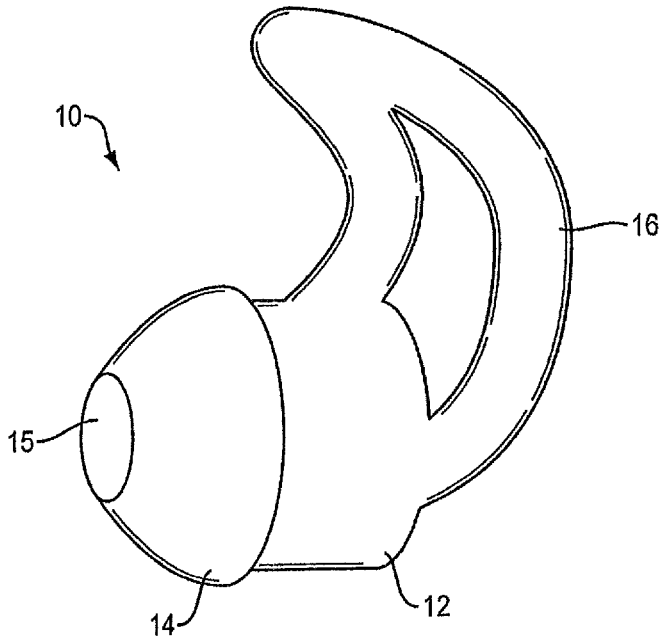
FIG. 1 is perspective view of an earphone.

Many wearable audio devices are powered by batteries that must be periodically charged. Battery charging can be accomplished by inductance or by direct electrical connection using a battery charger. The battery charger in some non-limiting examples may be built into a case that is also configured to store the wearable audio devices when they aren't in use. The battery charger can alternatively be carried by another structure such as a separate battery charging device. In order for the wearable audio device batteries to properly charge, the wearable audio device must be brought into close proximity to the battery charger, which requires the wearable audio device to be "docked" in the battery charger. Docking of wearable audio devices in a charger is often accomplished using magnetic attraction of the wearable audio devices to the correct location of the charger. A docking magnet located in the wearable audio device such that it is attracted to a magnet or magnetic material in the charger can be used to help properly locate and orient the wearable audio device in the charger.

Wearable audio devices, in particular earbuds, may be configured to allow the left and right earbuds to be held or "parked" together when not in use. Earbuds can also be configured to be parked to another structure, such as a neckband. Parking of earbuds is often accomplished with a parking or coupling magnet in the earbud, where the parking or coupling magnet is located such that it is at or very close to the surface of the earbud.

Wearable audio devices (one non-limiting example being earphones) can include one or both of a docking magnet and a parking magnet. Wearable audio devices many times include other magnetic devices, for example a magnetometer, the transducer magnet of an electro-acoustic transducer, ferrite cores (which may be used in filters, for example), and magnetic reed switches, to name only several of many possible magnetic devices in a wearable audio device such as an earbud. These magnetic devices are typically designed to operate without substantial interference from stray magnetic fields. Magnetic devices typically operate in a stable operational range only if the strength of any stray magnetic field is relatively low. The docking or parking magnet in a wearable audio device can emit stray magnetic fields that can negatively impact the operation of other magnetic devices of the wearable audio device.

When earphones include a magnetometer, since the earphone is small the magnetometer will of necessity be located close to the transducer magnet and/or the docking or parking magnet. The magnetic field from one or both of these magnets can overwhelm the magnetometer and prevent it from properly detecting the strength of the Earth's magnetic field. Also, the transducer magnet of an earphone is often times also located close to the docking or parking magnet. The stray magnetic field from the docking or parking magnet can weaken the transducer magnet, for example it can change the force constant of the transducer magnet, or make one side have a stronger force than the other side. This is important because the loudspeakers used in earphone products typically have only a single plane suspension element (e.g., they have a surround but no spider). A large stray magnetic field could thus lead to an undesirable rocking due to non-symmetric forces around the circumference of the loudspeaker.

Negative effects on the magnetic device due to the docking or parking magnet's stray magnetic field at the location of the magnetic device can be reduced if the docking or parking magnet is configured to have opposed first and second sides, wherein the flux of the magnetic field from the first side has a greater magnitude than the flux of the magnetic field from the second side, and when the second side is closer to the magnetic device than is the first side. Also, if the magnetic field from the docking or parking magnet and/or the transducer magnet at the location of the magnetic device might be large enough to have an effect on the stable operation of the magnetic device, the magnetic device can be brought into a region of stable operation by placing the wearable audio device docking or parking magnet and the transducer magnet, and orienting their magnetic fields, such that their combined magnetic fields are partially or fully nulled at the location of the magnetic device. Any nulling should be sufficient such that the magnetic device can operate in its operational region where stray magnetic fields do not overwhelm it.

FIG. 1 is a perspective view of a wireless in-ear headphone, earphone, or earbud, 10. An earphone is only one non-limiting example of the subject wearable audio device. Other examples are described elsewhere herein. Earbud 10 includes body or housing 12 that houses the active components of the earbud. Portion 14 is coupled to body 12 and is pliable so that it can be inserted into the entrance of the ear canal. Sound is delivered through opening 15. Retaining loop 16 is constructed and arranged to be positioned in the outer ear, for example in the antihelix, to help retain the earbud in the ear. Earbuds are well known in the field (e.g., as disclosed in U.S. Pat. No. 9,854,345, the disclosure of which is incorporated herein by reference for all purposes), and so certain details of the earbud are not further described herein. An earbud 10 is an example of a wearable audio device according to this disclosure, but is not limiting of the scope of the disclosure as stray magnetic fields from docking or parking magnets at the location of a magnetic device in in other types of wearable audio devices can also be resolved in accordance with the present disclosure.

Figure 2:
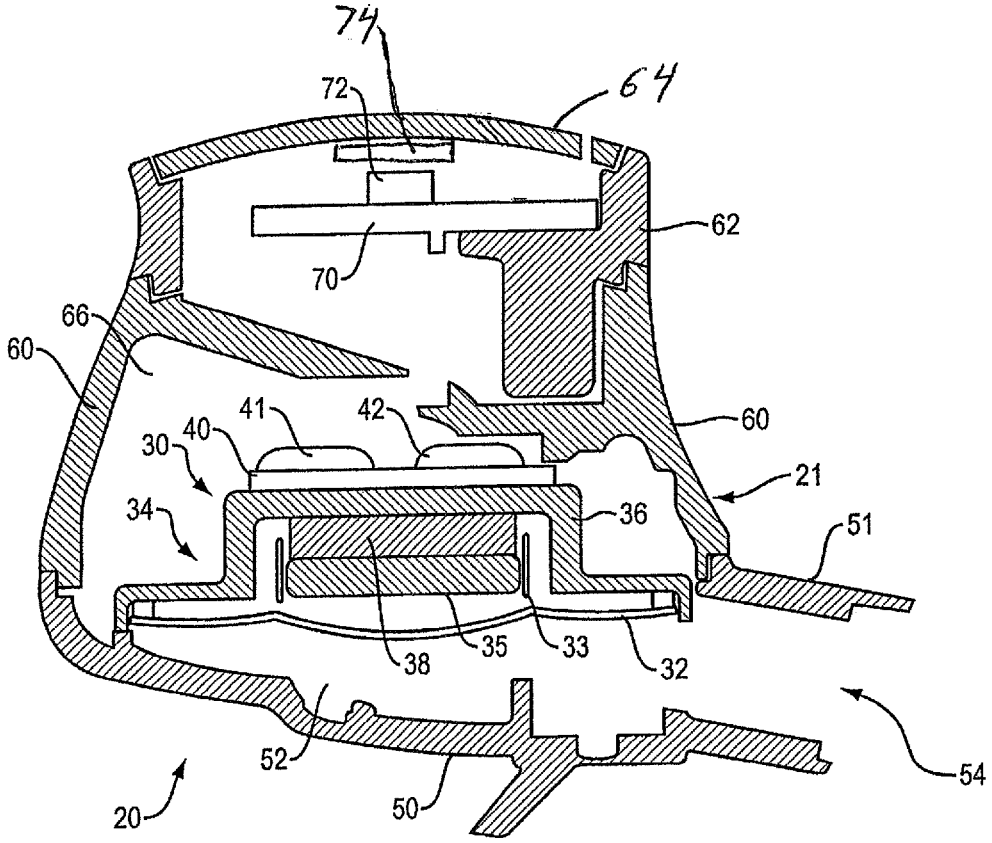
FIG. 2 is a partial cross-sectional view of elements of an earphone.

FIG. 2 is a partial cross-sectional view of only certain elements of an earphone 20 that are useful to a better understanding of the present disclosure. Earphone 20 comprises housing 21 that encloses electro-acoustic transducer 30. Housing 21 comprises front housing portion 50 and rear housing portions 60 and 62. Transducer 30 has diaphragm 32 that is driven in order to create sound pressure in front cavity 52. Sound pressure is directed out of front housing portion 50 via opening 54. When earphone 20 is an earbud, as shown for example by earbud 10 in FIG. 1, there is typically a pliable tip (not shown in FIG. 2) that is engaged with neck 51 of housing portion 50, to help direct the sound into the ear canal. Earphone housing 21 further comprises a rear enclosure made from rear housing portions 60 and 62, and grille 64. Note that the details of earphone 20 are exemplary of aspects of earphones and are not limiting of the scope of this disclosure, as the present magnetic field reduction at the location of the magnetometer or other magnetic device can be used in varied types and designs of earphones and other wearable audio devices.

Transducer 30 further comprises magnetic structure 34. Magnetic structure 34 comprises transducer magnet 38 and magnetic material that functions to confine and guide the magnetic field from magnet 38, so that the field properly interacts with coil 33 to drive diaphragm 32, as is well known in the electro-acoustic transducer field. The magnetic material comprises cup 36 and front plate 35, both of which are preferably made from a material with relatively high magnetic susceptibility, also as is known in the field. Transducer printed circuit board (PCB) 40 carries electrical and electronic components (not shown) that are involved in driving the transducer. Pads 41 and 42 are locations where wires (not shown) can be coupled to PCB 40.

Parking magnet 74 is in this non-limiting example located just inside of grill 64. It should be understood that a parking magnet is generally located inside of or at the least close to (adjacent) the inside surface of earphone housing 21 at a location where it can act to help park the earphone to another structure, such as another earphone housing. Magnet 74 could alternatively be a coupling or docking magnet, which would generally be located inside of or at the inside surface of housing 21 at a location where it can act to help dock the earphone to a battery charger. More specifically, one possible location of a coupling magnet would be somewhere on the interior of front housing portion 50 inside front cavity 52.

Three-axis magnetometer 72 is mounted on PCB 70 and is arranged to sense the strength of magnetic fields in three axes at the location of the magnetometer, as is known in the field. Magnetometer 72 is configured to detect the Earth's magnetic field. The output of magnetometer 72 can be used to determine the direction in which the wearer's head is pointed, as described in U.S. Patent Application 62/626,967, filed on Feb. 6, 2018, the entire disclosure of which is incorporated herein by reference. As discussed above, earphone 20 may additionally or alternatively include other magnetic devices that might be adversely impacted by the stray magnetic field from a coupling, docking or parking magnet.

Since magnetometer 72 is relatively close to transducer magnet 38 and/or parking or docking magnet 74, the magnetic field from one or both of these magnets can overwhelm the magnetometer and prevent it from properly detecting the strength of the Earth's magnetic field. The magnetometer should be operated in its stable operational range, where stray magnetic fields do not skew the desired measurement. Stable operation can be accomplished by configuring or arranging one or both of the docking or parking magnet 74 and the transducer magnet 38 such that their combined magnetic fields at the location of the magnetometer 72 are below the level where the field would destabilize the magnetometer. Linear operation of magnetometers (where there are stray magnetic fields that are not so strong that they overwhelm sensing or detection of the desired field) is known in the technical field, and so is not further described herein.

The docking or parking magnet (e.g., magnet 74) has opposed first and second sides. The second side of the docking or parking magnet is closer to the magnetic field sensor (or a different magnetic device) than is the first side. The flux of the magnetic field from the first side of the docking or parking magnet has a greater magnitude than the flux of the magnetic field from its second side. In one non-limiting example the docking or parking magnet comprises a Halbach array. A Halbach array is a configuration of three or more permanent magnets, or three or more differently magnetized regions of a monolithic structure, arranged such that on one side of the Halbach array the magnetic fields reinforce and on another side of the Halbach array (typically, the opposite side) the fields cancel. One arrangement, which may be termed a discrete Halbach array, comprises three permanent magnets arranged side-by-side into a generally planar Halbach array. Another arrangement, which may be termed a continuous Halbach array, comprises three side-by-side regions of a monolithic structure where the regions are magnetized differently from one another.

An advantage of a Halbach array is that its magnetic field is strong on one side and weak on the other side. If the side on which the field is strong is placed close to or against the inside surface of a wireless audio device housing, the field is better able to couple or park to another structure. At the same time, the field on the opposite side facing into the wireless audio device housing is weak and so it has less effect on the magnetometer and/or other magnetic device(s) as compared to a single magnet that has equal field strength on both sides, used as a parking or docking magnet. The effect of the Halbach array field at the magnetometer and/or other magnetic device(s) may be small enough that a separate nulling magnet may not be needed. In other words, the combined fields at the magnetometer and/or other magnetic device(s) from the Halbach array and the transducer magnet(s) may be small enough that the magnetometer and/or other magnetic device(s) can operate in its linear range without the need for an additional nulling magnetic field. Another advantage of a Halbach array is that it can achieve the same parking or docking field as a single magnet in less volume and less thickness than a single magnet. This frees up space in the earphone for other components or other functionalities. Another advantage is that the magnetic field on one side of the parking/docking magnet is stronger than the magnetic field of a comparably-sized single magnet.

Figure 3:
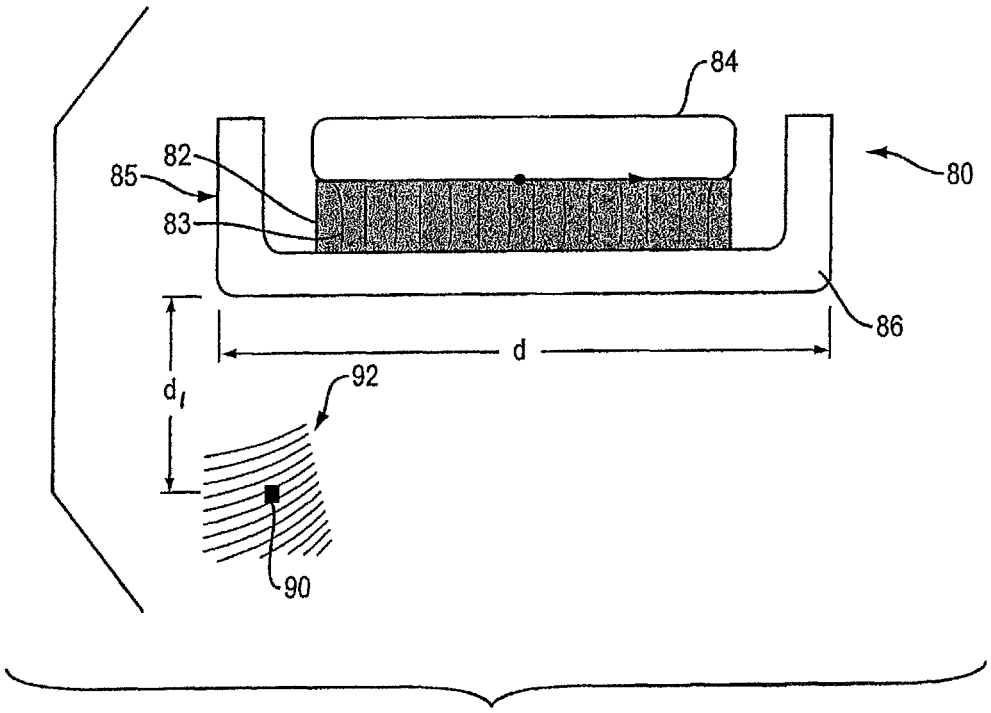
FIG. 3 is a schematic view of the magnetic structure of an earphone and its magnetic field at the location of a magnetic field sensor.
Figure 4:
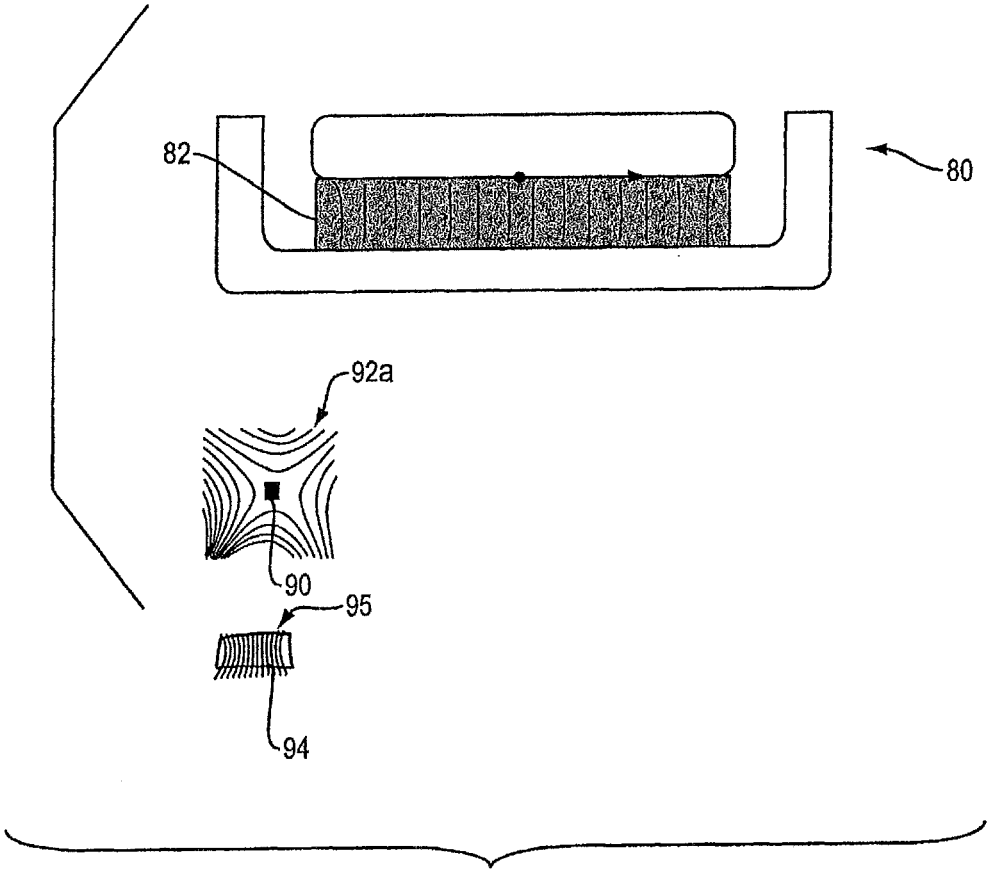
FIG. 4 is a view similar to that of FIG. 3 but including a nulling magnet.

FIGS. 3 and 4 illustrate aspects of an earphone. Earphone electro-acoustic transducer 80 comprises magnet 82, and a magnetic structure 85 that comprises cup 86 and front member 84. Magnet 82 has a magnetic field, which is represented by the generally vertical field line representations 83. Note that the magnet could additionally or alternatively be the docking or parking magnet. Magnetic fields and field line representations are well known in the art and so are not further described herein. The magnetic structure 85 spans a distance "d." Magnetometer 90 is spaced a distance "$d_1$" from magnetic structure 85. The field from magnet 83 in the vicinity of magnetometer 90 is represented by field lines 92. In the example, the field strength of the magnetic field from magnet 82 in the vicinity of magnetometer 90 is about 500 μT. In contrast, the strength of the Earth's magnetic field is generally approximately 50 μT, or about $1/10^{th}$ of the field from magnet 82. With a stray field such as this that overwhelms the field to be sensed, magnetometer 90 can be inaccurate. Accordingly, the look direction sensing involving magnetometer 90 can be inaccurate. It should be understood that electro-acoustic magnet transducers can have varied shapes, sizes, locations, and field strengths, and that the illustrative values set forth in the examples are not limiting of the scope of this disclosure.

FIG. 4 illustrates schematically an effect of a nulling magnet 94 (when used). Nulling magnet 94 has a magnetic field, which is represented by the generally vertical field line representations 95. Nulling magnet 94 has a size, shape, magnetic orientation, magnetic field strength, and location relative to transducer 80 and magnetometer 90 such that its magnetic field is superimposed on the field from the transducer magnet 82 sufficiently to fully or partially null the transducer field in three axes, at the location of magnetometer 90. In this non-limiting example, field nulling is indicated by field line representation 92*a*, showing a field null at magnetometer 90 (i.e., no field lines intersect magnetometer 90). Note that nulling could be accomplished with one or more separate nulling magnets. Also, the field that is nulled could be from the transducer magnet and/or from the parking or docking magnet. The nulling should be sufficient to reduce the stray magnetic field(s) to below the level where the magnetometer can operate in its normal operational range. The strength of stray fields that would bring a magnetometer out of its normal operational range are dependent on the particular magnetometer used.

It should be understood that the stray field or fields do not need to be fully nulled by nulling magnet 94. Rather, as described above, the strength of any stray magnetic field needs to be reduced sufficiently such that the magnetometer can sense the Earth's magnetic field. The reduction in the stray magnetic field at the magnetometer that needs to be accomplished with the nulling magnet will in part depend on the particular magnetometer used, as would be apparent to one skilled in the field. Also, it should be understood that magnetic fields are three-dimensional, while FIGS. 3 and 4 are two-dimensional. Those skilled in the field will understand the extent to which stray magnetic fields in three dimensions need to be nulled in order for the sensing of the Earth's magnetic field to be accomplished with sufficient accuracy for the particular application of the Earth's magnetic field sensor, and can make an appropriate selection of the nulling magnet parameters described above as needed to accomplish such results.

Figure 5:
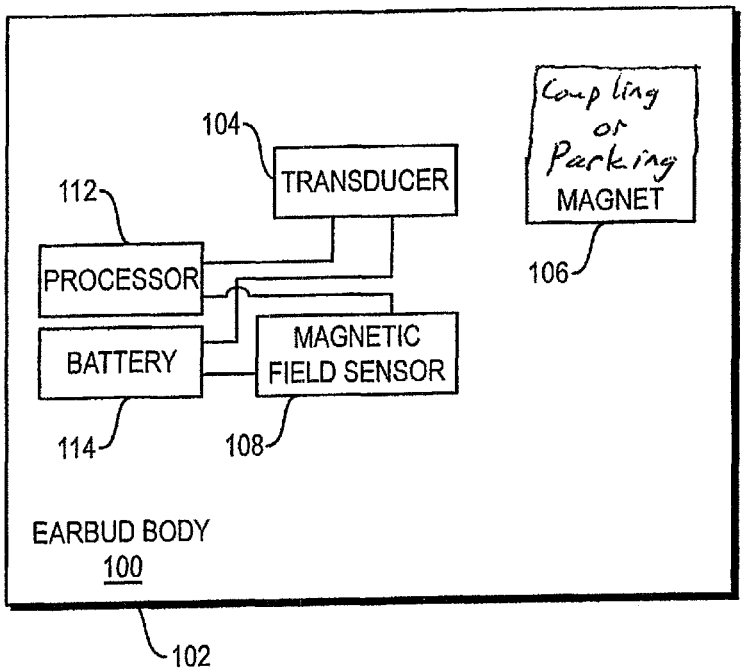
FIG. 5 is a schematic diagram of an earphone.

FIG. 5 is a schematic diagram of in-ear headphone 102, illustrating in part a coupling or parking magnet 106. The described components are located in earbud body 100. Battery 114 provides power to powered components. Processor 112 is used, in part, to drive transducer 104. Processor 112 is also used to determine the wearer's look direction, in part using the output of magnetic field sensor 108. It should be understood that earphones will have more components and can have different components than those shown in FIG. 5. Some earphones include a magnet other than the transducer magnet. This other magnet is represented in this non-limiting example by coupling or parking magnet 106. Coupling or parking magnet 106 can be used to couple or park earphone 100 to another structure. As one non-limiting example, magnet 106 can be used to "dock" an earbud to a battery charger. As another non-limiting example, magnet 106 can be used to park an earbud to another structure, such as a neckband or another earbud. Other uses of coupling and/or parking magnets are known in the field and are included within the scope of the present disclosure.

All of the magnets in earbud body 100 of earphone 102 create magnetic fields that can adversely impact the accuracy of the sensing of the Earth's magnetic field by sensor 108, as described above. By proper sizing, orientation and placement of magnet 106 and the transducer magnet, the combined magnetic fields from the magnets in earbud body 100 at sensor 108 can be low enough such that sensor 108 can detect the Earth's magnetic field, as described above.

Figure 6:
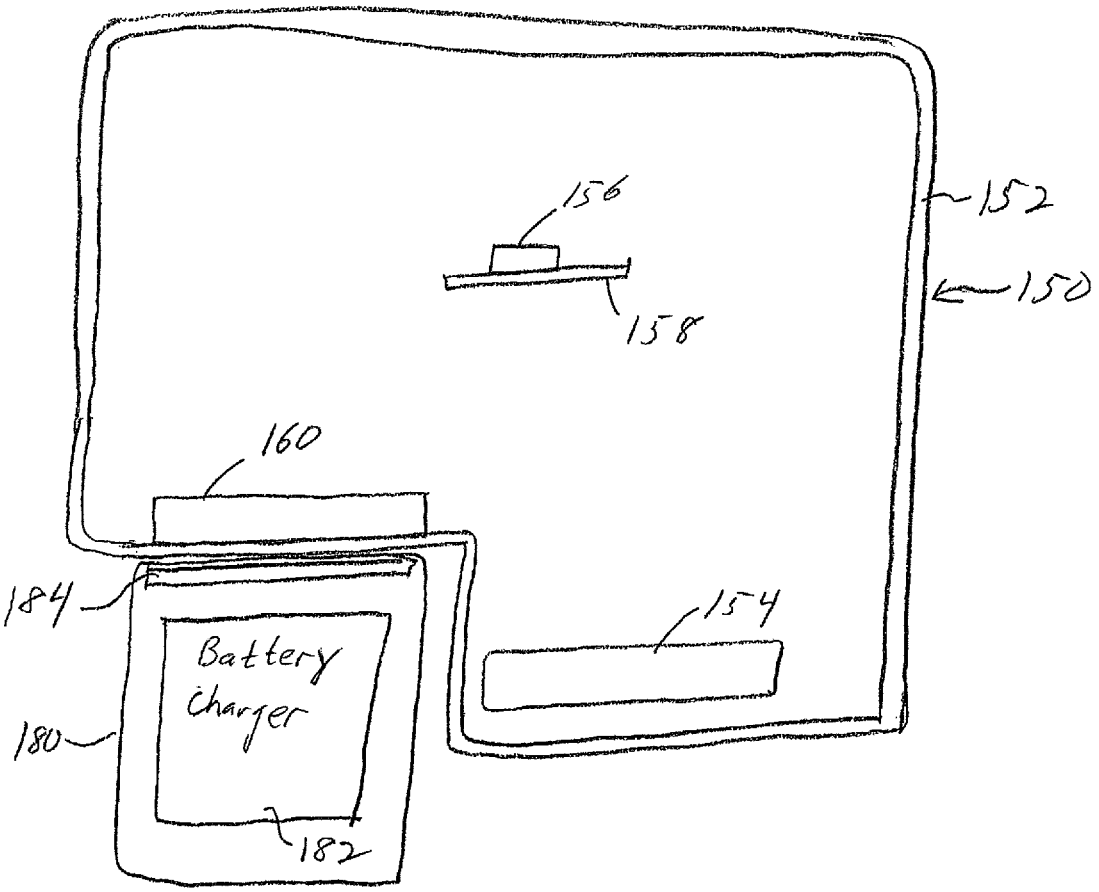
FIG. 6 is a partial, schematic, cross-sectional diagram of an earbud docked to a battery charging device.

FIG. 6 is a partial, schematic, cross-sectional diagram of an earbud 150 docked to a battery charging device 180. Most of the components of earbud 150 are not included, simply for ease of illustration. Earbud 150 includes earbud body 152. Inside of body 152 are transducer magnet 154 and three-axis magnetometer 156 that is located on printed circuit board (PCB) 158. Docking magnet 160 is in this non-limiting example a Halbach array with a relatively strong magnetic field on one side of the array (the outside) and a relatively weak field on the opposite side of the array (the inside). Magnet 160 is typically located just inside of earbud body 152 or it can even be located such that it is exposed to the outside of body 152. Magnet 160 is used to hold earbud 150 against and in the correct orientation relative to charging device 180 such that the earbud batteries (not shown) can be recharged by charging device 180 via its battery charger 182. Battery charger 182 can work by induction or by direct electrical connection to the earbud batteries, as is known in the field. Magnet or magnetic metal plate 184 of battery charging device 180 can help to dock the earbud to the charging device. Magnet 160 is located, sized and oriented such that it has little impact on the operation of magnetometer 156. Also, magnet 160 can, if necessary, partially or fully null the magnetic field from magnet 154 at sensor 156. Or, the field from magnet 154 can null the field from magnet 160. Stated another way, the combined fields from magnets 154 and 160 at the location of the magnetometer can be less than the strength of each of the two fields individually. Magnet 160 thus may or may not have dual functions (docking and nulling) in the earbud. Note that either of both of the docking and parking or clasping magnet can be a Halbach array.

Figure 7:
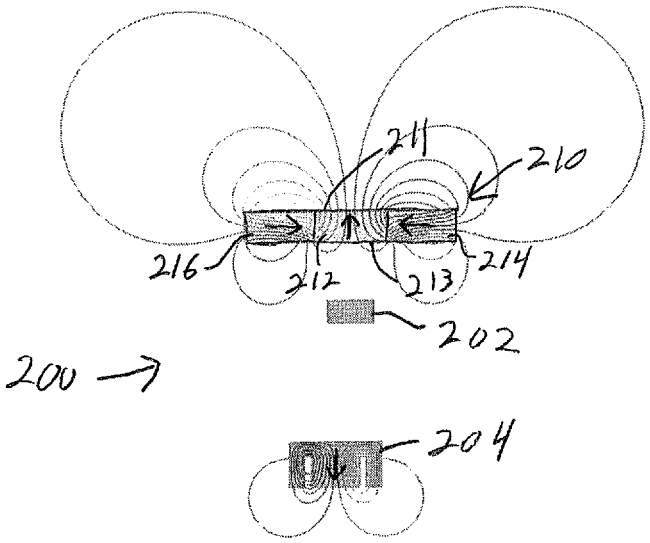
FIG. 7 is a partial, schematic view of a transducer, magnetometer and parking or docking magnet of an earphone.

FIG. 7 illustrates a result of one arrangement of earphone magnets according to this disclosure. Magnetometer 202 is located between transducer 204 and docking or parking magnet 210. Docking or parking magnet 210 comprises a Halbach array of three co-planar and adjacent (touching) bar magnets 212, 214, and 216. The north directions of the magnetic fields of the three magnets all point in different directions, as indicated by the arrows; center magnet 212 has its north pointing up, right side magnet 214 has its north pointed toward center magnet 212, and left side magnet 216 has its north pointed toward center magnet 212. As is shown by the field lines, the field proximate upper array surface 211 is substantially stronger than the field proximate lower (opposite) array surface 213. Accordingly, any stray field at the location of magnetometer 202 may be sufficiently small that it does not negatively impact the operation of magnetometer 202. Also, the magnet of transducer 204 has its north pointed down as indicated by the arrow. A result is that the fields of array 210 and transducer 204 that face one another have the same direction (in this non-limiting case, the direction is south, but it could be north). Also, shielding or other arrangements of transducer 204 inhibit its field at the location of magnetometer 202 from negatively impacting the operation of magnetometer 202. As one non-limiting example of an effect of using a Halbach array 210 with its weak-field side facing one particular non-limiting example of a magnetometer, a Halbach array comprising three adjacent magnets oriented as depicted in FIG. 7, each with Br=1.345 T (where Br represents the strength (e.g., the flux density) of the magnet), and each magnet having dimensions 2.3 mm×5 mm, and 1 mm thick, and located 2.5 mm from a magnetometer created a stray z-axis magnetic field at the magnetometer of only about 1000 μT, which is below the approximately 2500 μT limit of stray fields that might take the magnetometer out of its linear operational range.

Figure 8:
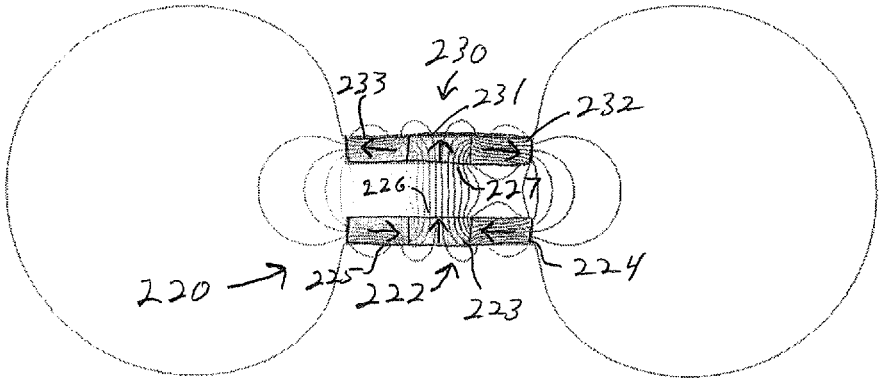

When Halbach arrays are used both in the earphone and in a structure to which an earphone is configured to be coupled (such as a battery charger or another earphone), the two Halbach arrays 220 can be arranged such that their sides with strong fields face each other and with the facing fields having opposite polarity so that they strongly attract. An example is shown in FIG. 8, wherein first Halbach array 222 comprises center magnet 223 and right and left side magnets 224 and 225 with their north polarities indicated by the arrows, creating a strong north field at top surface 226 that faces second Halbach array 230. Second array 230 has center magnet 231 and right and left side magnets 232 and 233 with their north polarities facing away from magnet 231, as indicated by the arrows, creating a strong south field at lower surface 227 that faces first array 222. The attractive force can be greater than an attractive force created by two single magnets each about the same size as a Halbach array.

One or more of the above described systems and methods, in various examples and combinations, may be used in a wide variety of audio systems, including wearable audio devices in various form factors. Unless specified otherwise, the term wearable audio device, as used in this document, includes headphones and various other types of personal audio devices such as head, shoulder or body-worn acoustic devices (e.g., audio eyeglasses or other head-mounted audio devices) that include one more acoustic transducers to receive and/or produce sound, with or without contacting the ears of a user. It should be noted that although specific implementations of speaker systems primarily serving the purpose of acoustically outputting audio are presented with some degree of detail, such presentations of specific implementations are intended to facilitate understanding through provisions of examples and should not be taken as limiting either the scope of disclosure or the scope of claim coverage.

Elements of FIG. 5 are shown and described as discrete elements in a block diagram. These may be implemented as one or more of analog circuitry or digital circuitry. Alternatively, or additionally, they may be implemented with one or more microprocessors executing software instructions. The software instructions can include digital signal processing instructions. Operations may be performed by analog circuitry or by a microprocessor executing software that performs the equivalent of the analog operation. Signal lines may be implemented as discrete analog or digital signal lines, as a discrete digital signal line with appropriate signal processing that is able to process separate signals, and/or as elements of a wireless communication system.

When processes are represented or implied in the block diagram, the steps may be performed by one element or a plurality of elements. The steps may be performed together or at different times. The elements that perform the activities may be physically the same or proximate one another, or may be physically separate. One element may perform the actions of more than one block. Audio signals may be encoded or not, and may be transmitted in either digital or analog form. Conventional audio signal processing equipment and operations are in some cases omitted from the drawing.

The example of FIG. 5 comprises a processor that is configured to use computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

A number of implementations have been described. Nevertheless, it will be understood that additional modifications may be made without departing from the scope of the inventive concepts described herein, and, accordingly, other examples are within the scope of the following claims.

What is claimed is:

1. A wearable audio device, comprising:

a magnetic device that comprises a transducer magnet of an electro-acoustic transducer that is adapted to create an audio output;

a magnetic field sensor; and a docking or parking magnet that has opposed first and second sides and produces a magnetic field, wherein the flux of the magnetic field from the first side has a greater magnitude than the flux of the magnetic field from the second side, and wherein the second side is closer to the magnetic field sensor than is the first side;

wherein the combined strengths of the magnetic fields from the docking or parking magnet and the transducer magnet, at a location of the field sensor, is less than either a strength of the magnetic field from the transducer magnet at the location of the magnetic field sensor when no other magnets are present or a strength of the magnetic field from the docking or parking magnet at the location of the magnetic field sensor when no other magnets are present.

2. The wearable audio device of claim 1, wherein the magnetic field sensor comprises a magnetometer.

3. The wearable audio device of claim 1, wherein the magnetic field sensor comprises a three-axis magnetometer.

4. The wearable audio device of claim 1, wherein the docking or parking magnet comprises a Halbach array.

5. The wearable audio device of claim 4, wherein the Halbach array comprises a discrete array comprising at least three permanent magnets arranged side-by-side and with the north poles of three adjacent magnets all pointing in different directions.

6. The wearable audio device of claim 4, wherein the Halbach array comprises a continuous array comprising a monolithic structure.

7. The wearable audio device of claim 1, further comprising a housing that is constructed and arranged to be positioned at or near an ear of a wearer so as to direct the audio output of the electro-acoustic transducer towards the ear of the wearer, wherein the housing comprises an outer wall.

8. The wearable audio device of claim 7, wherein the docking or parking magnet is positioned in the housing adjacent to the housing outer wall.

9. The wearable audio device of claim 1, comprising an earbud with an earbud body, and wherein the magnetic device, the magnetic field sensor, and the docking or parking magnet are located in the earbud body.

10. The wearable audio device of claim 1, wherein the magnetic field sensor has a sensed magnetic field range where it operates linearly, and wherein the strength of the magnetic field from the docking or parking magnet, at the location of the magnetic field sensor, is such that the sensed magnetic field strength is in the sensed magnetic field range where the magnetic field sensor operates linearly.

11. A wearable audio device, comprising:

a housing that is constructed and arranged to be positioned at or near an ear of a wearer so as to direct an audio output towards the ear of the wearer, wherein the housing comprises an outer wall;

a magnetometer in the housing and configured to sense the Earth's magnetic field, wherein the magnetometer has a sensed magnetic field range where it operates linearly;

an electro-acoustic transducer in the housing and configured to create the audio output, wherein the transducer comprises a transducer magnet that produces a transducer magnetic field having a transducer magnetic field strength; and a docking or parking magnet comprising a Halbach array of at least three side-by-side permanent magnets or magnetic regions of a monolithic structure, wherein the north poles of three adjacent permanent magnets or magnetic regions all point in different directions;

wherein the docking or parking magnet has opposed first and second sides, wherein the first side of the docking or parking magnet faces and is proximate to the outer wall of the housing and the second side of the docking or parking magnet is closer to the magnetometer than is the first side of the docking or parking magnet;

wherein the flux of the magnetic field from the first side of the docking or parking magnet has a greater magnitude than the flux of the magnetic field from the second side of the docking or parking magnet; and wherein the combined strengths of the transducer magnetic field and the magnetic field from the second side of the docking or parking magnet, at a location of the magnetometer, is such that a sensed magnetic field strength is in the sensed magnetic field range where the magnetometer operates linearly.

12. The wearable audio device of claim 11, wherein the combined strengths of the transducer magnetic field and the magnetic field from the second side of the docking or parking magnet, at the location of the magnetometer, is less than either the strength of the transducer magnetic field at the location of the magnetometer when no other magnets are present or the strength of the magnetic field from the second side of the docking or parking magnet at the location of the magnetometer when no other magnets are present.

13. The wearable audio device of claim 11, wherein the magnetometer comprises a three-axis magnetometer.

14. The wearable audio device of claim 11, wherein the magnetic field from the first side of the docking or parking magnet has a primary magnetic pole orientation facing into the housing, and wherein the transducer magnetic field has a primary magnetic pole orientation facing away from the docking or parking magnet.

15. The wearable audio device of claim 11, wherein the docking or parking magnet comprises a center bar magnet with opposed first and second ends, and with its north pole pointed toward the housing, a first end bar magnet adjacent to the first end of the center bar magnet and with its north pole pointing toward the center bar magnet, and a second end bar magnet adjacent to the second end of the center bar magnet and with its north pole pointing toward the center bar magnet.

16. The wearable audio device of claim 11, wherein the docking or parking magnet comprises a center magnetic region with opposed first and second ends, and with its north pole pointed toward the housing, a first end magnetic region adjacent to the first end of the center magnetic region and with its north pole pointing toward the center magnetic region, and a second end magnetic region adjacent to the second end of the center magnetic region and with its north pole pointing toward the center magnetic region.

17. The wearable audio device of claim 11, configured to be clasped to another structure that comprises a clasping Halbach array, and wherein the magnetic field from the first side of the docking or parking magnet has a first primary magnetic pole orientation facing into the housing, and wherein when the wearable audio device is clasped to the other structure the clasping Halbach array of the other structure has an opposite, second primary magnetic pole orientation facing toward the docking or parking magnet.

18. The wearable audio device of claim 17, wherein the other structure comprises a second earphone.

19. The wearable audio device of claim 17, wherein the other structure comprises a battery charger.

20. A wearable audio device, comprising:

a housing that is constructed and arranged to be positioned at or near an ear of a wearer so as to direct an audio output towards the ear of the wearer, wherein the housing comprises an outer wall;

a magnetometer in the housing and configured to sense the Earth's magnetic field;

an electro-acoustic transducer in the housing and configured to create the audio output, wherein the transducer comprises a transducer magnet that produces a transducer magnetic field having a transducer magnetic field strength; and a docking or parking magnet comprising a Halbach array of at least three side-by-side permanent magnets or magnetic regions of a monolithic structure, wherein the north poles of three adjacent permanent magnets or magnetic regions all point in different directions;

wherein the docking or parking magnet has opposed first and second sides, wherein the first side of the docking or parking magnet faces and is proximate to the outer wall of the housing and the second side of the docking or parking magnet is closer to the magnetometer than is the first side of the docking or parking magnet;

wherein the flux of the magnetic field from the first side of the docking or parking magnet has a greater magnitude than the flux of the magnetic field from the second side of the docking or parking magnet; and wherein the combined strengths of the transducer magnetic field and the magnetic field from the second side of the docking or parking magnet, at a location of the magnetometer, is less than either the strength of the transducer magnetic field at the location of the magnetometer when no other magnets are present or a strength of the magnetic field from the second side of the docking or parking magnet at the location of the magnetometer when no other magnets are present.

* * * * *